US008246035B2

(12) United States Patent
Ito

(10) Patent No.: US 8,246,035 B2
(45) Date of Patent: Aug. 21, 2012

(54) IMAGE READING APPARATUS AND IMAGE FORMING APPARATUS

(75) Inventor: Sakae Ito, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 230 days.

(21) Appl. No.: 12/607,399

(22) Filed: Oct. 28, 2009

(65) Prior Publication Data

US 2010/0102500 A1 Apr. 29, 2010

(30) Foreign Application Priority Data

Oct. 29, 2008 (JP) ..... 2008-278391

(51) Int. Cl.
*B65H 5/22* (2006.01)
*B65H 83/00* (2006.01)
*B65H 85/00* (2006.01)

(52) U.S. Cl. ..... 271/3.14

(58) Field of Classification Search ..... 271/3.14
See application file for complete search history.

(56) References Cited

U.S. PATENT DOCUMENTS 5,534,989 A * 7/1996 Rubscha et al. ..... 399/381
7,429,039 B2 * 9/2008 Hattori et al. ..... 271/10.01
7,931,263 B2 * 4/2011 Takahagi et al. ..... 271/3.01
2003/0011121 A1 * 1/2003 Kobayashi et al. ..... 271/3.14
2006/0180972 A1 * 8/2006 Suzuki ..... 271/3.14
2006/0268376 A1 * 11/2006 Kawashima ..... 358/498
2007/0069445 A1 * 3/2007 Kakuta ..... 271/3.14
2007/0069451 A1 3/2007 Iwago et al.
2009/0189328 A1 * 7/2009 Ohama et al. ..... 271/3.14
2009/0309287 A1 * 12/2009 Watanabe et al. ..... 271/3.14

FOREIGN PATENT DOCUMENTS

JP 61051441 A * 3/1986
JP 2003-050483 A 2/2003
JP 2007-084326 A 4/2007
JP 2003-098767 A 10/2009

* cited by examiner

*Primary Examiner* — Kaitlin Joerger
*Assistant Examiner* — Prasad Gokhale
(74) *Attorney, Agent, or Firm* — Banner & Witcoff, Ltd.

(57) ABSTRACT

An image reading apparatus, which may be used in an image forming apparatus includes a document table including a flat surface for receiving a document, and a document cover that can be moved between a first position covering the flat surface and a second position exposing the flat surface. The image reading apparatus may further include an automatic document feeder disposed on the document cover that can automatically feed a document toward the flat surface. The automatic document feeder includes a gear train, and a gear cover covering a portion of the gear train, wherein the gear cover includes a protrusion that protrudes downward below the flat surface of the document table.

9 Claims, 15 Drawing Sheets

IMAGE READING APPARATUS AND IMAGE FORMING APPARATUS

CROSS REFERENCE TO RELATED APPLICATION

This application claims priority from Japanese Patent Application No. 2008-278391, filed on Oct. 29, 2008, the entire subject matter of which is incorporated herein by reference.

FIELD

Aspects of the invention relate to an image reading apparatus having a stationary document reading function and an automatic document feeding and reading function, and an image forming apparatus having such an image reading apparatus.

BACKGROUND

A known image forming apparatus includes an automatic document feeder for automatically feeding a document for use in an automatic document feeding and reading function. The automatic document feeder requires a gear train including a plurality of gears.

When the size of the gear train is increased because of an increase in the number of gears, often the size of the automatic document feeder will be increased, especially the height of the image reading apparatus.

SUMMARY

Aspects of the invention may provide an image reading apparatus having a relatively low-profile and an image forming apparatus including such an image reading apparatus.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus to which aspects of the invention are applied, e.g. a multifunction apparatus, includes an image reading unit or image reader, e.g. a scanner unit, and an image forming unit, e.g. a printer unit. It will be appreciated that aspects of the invention apply to other types of image forming apparatuses as well.

The general structure of an illustrative image forming apparatus 1 will be described with reference to FIG. 1.

For ease of discussion, in the following description, the top or upper side, the bottom or lower side, the left or left side, the right or right side, the front or front side, and the rear or rear side of the image forming apparatus 1 will be identified as indicated by the arrows in FIG. 1. With regard to various individual objects of the image forming apparatus 1, sides of the individual objects will be similarly identified based on the arranged/attached position of the object on/in the image forming apparatus 1 shown in FIG. 1. The top and bottom direction may be referred to as a height direction, and the left and right direction may be referred to as a width direction.

Figure 1:
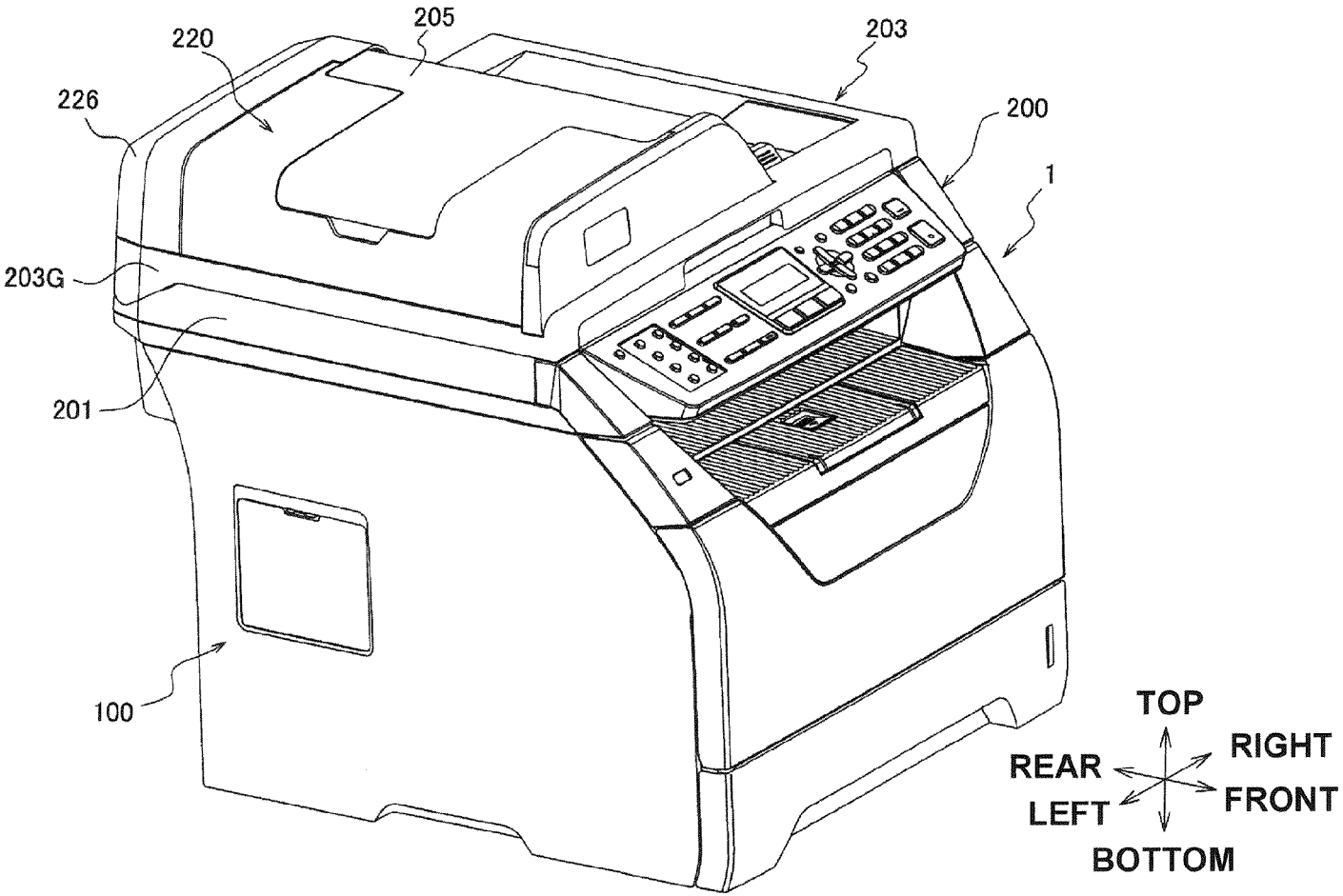
FIG. 1 is a perspective view of an image forming apparatus according to an illustrative embodiment.

As shown in FIG. 1, the image forming apparatus 1 includes an image forming unit 100, and an image reading unit 200 disposed above the image forming unit 100. The image forming unit 100 is of an electrophotographic type and configured to form an image on a medium, e.g. a recording sheet. The image reading unit 200 is configured to read an image such as printed text or handwriting on a document.

The image reading unit 200 includes a flatbed reading function in which a stationary document placed on a flat surface is read, and an automatic document feeding and reading function (ADF reading function) in which a document that is automatically fed is read.

Figure 2:
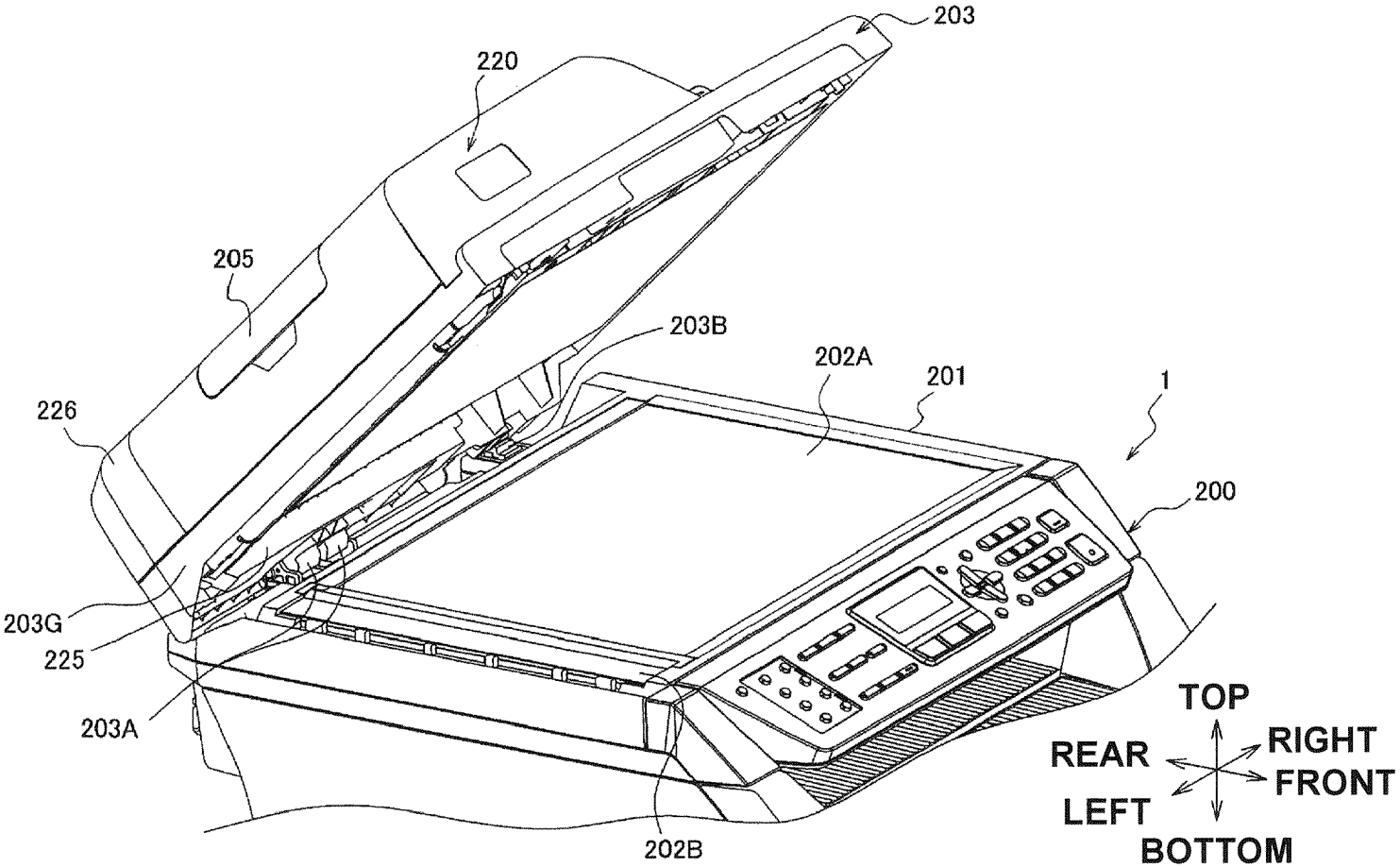
FIG. 2 is a perspective view of the image forming apparatus in which a document cover is open according to an illustrative embodiment.

As shown in FIG. 2, the image reading unit 200 includes a document table 201 and a first reading window 202A disposed in the document table 201. The first reading window 202A has a flat rectangular shape and is made of a transparent material, e.g., glass or acryl. In the flatbed reading function, a document is placed on the first reading window 202A.

The image reading unit 200 includes a document cover 203. The document cover 203 is disposed on the document table 201 and pivotally connected to the document table 201 via hinge mechanisms 203A and 203B. The document cover 203 is movable between a first position in which the first reading window 202A is covered (as shown FIG. 1) and a second position in which the first reading window 202A is exposed (FIG. 2).

In the flatbed reading function, the user lifts up the document cover 203 and places a document to be read on the first reading window 202A. An image sensor (not shown) is disposed below the first reading window 202A in the document table 201, which is on an opposite side of the first reading window 202A from the document cover 203. The image sensor is configured to receive light reflected by the document and generate electrical signals based on the received light.

The image reading unit 200 is configured to read an image, e.g. characters, written or printed on a document by converting the image into an electrical signal via the image sensor.

The image sensor is mounted in the document table 201 so as to move in a longitudinal direction of the document cover 201 (or left-right direction of FIG. 2). In the flatbed reading function, the image sensor moves immediately under the first reading window 202A to read an image of a document placed on the first reading window 202A. In the ADF reading function, the image sensor remains stopped immediately below a second reading window 202B to read an image of a document passing over the second reading window 202B.

The second reading window 202B has a flat rectangular shape and is disposed on the same side as the first reading window 202A with respect to the document cover 203 and at an end of the document table 201 with respect to the longitudinal direction (e.g. at an left end of the document table 201 in FIG. 2). The second reading window 202B is flush with the first reading window 202A. In the illustrative embodiment, the first reading window 202A and the second reading window 202B are provided individually. However, the first reading window 202A and the second reading window 202B may be made of a single member and the single member may include an area for the second reading window 202B at an end of the document table 201 with respect to the longitudinal direction thereof.

An automatic document feeder (ADF) 220 is disposed on the document cover 203.

Figure 3:
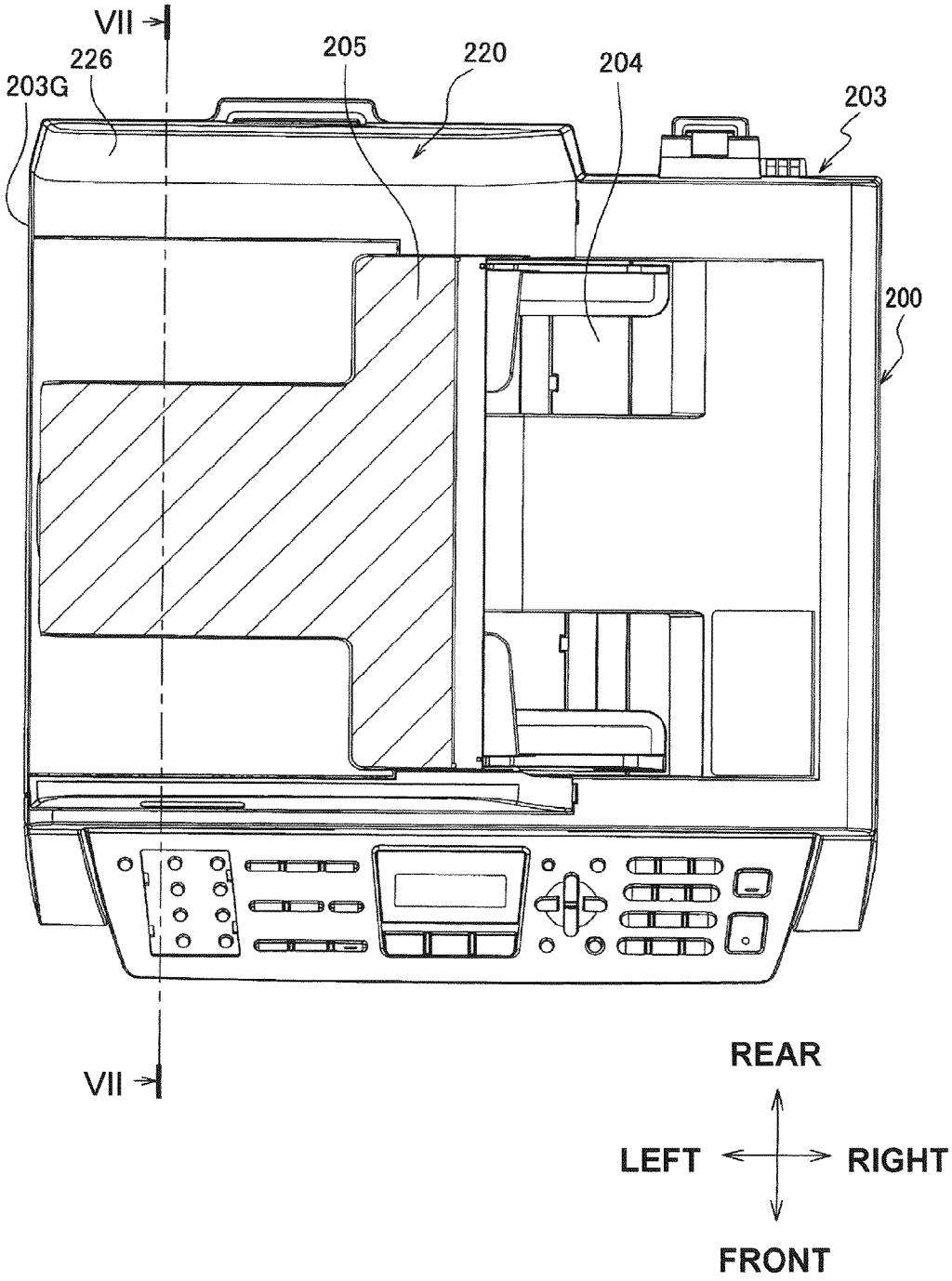
FIG. 3 is a top view of an image reading device according to an illustrative embodiment.

The ADF 220 is configured to automatically feed a document placed on a document tray 204 (FIG. 3), which is disposed on an upper surface of the document cover 203, toward the second reading window 202B, and automatically eject the document read at the second reading window 202B to an output tray 205, which is disposed in an upper portion of the document tray 204 (the diagonally shaded areas in FIG. 3).

In the illustrative embodiment, the output tray 205 is collapsible. In FIGS. 1-3, the output tray 205 is shown as being collapsed. When a document is read in the ADF reading function or in used with the ADF 220 in the image reading unit 200, the collapsed output tray 205 is extended toward the right in FIG. 3 and over the document tray 204.

As known, the ADF 220 includes a separation mechanism (not shown) that separates a stack of documents in the document tray 204 one by one, a first feeder (not shown) that feeds the documents separated by the separation mechanism one at a time toward the second reading window 202B, and a second feeder (not shown) that feeds the documents read at the second reading window 202B one at a time to the output tray 205.

Figure 4:
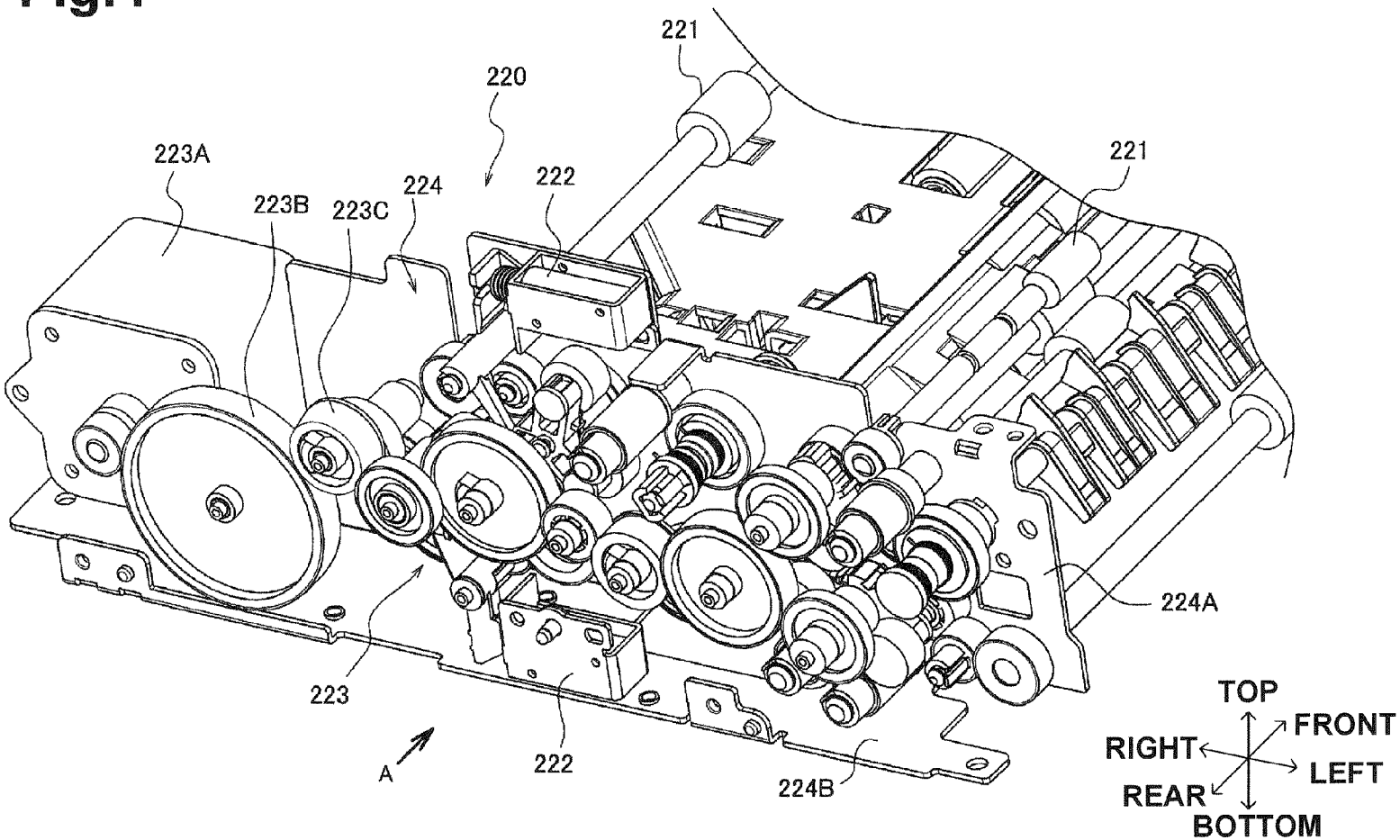
FIG. 4 is a perspective view of a gear train of an automatic document feeder according to an illustrative embodiment.

The separation mechanism, the first feeder, and the second feeder have feed rollers 221 (FIG. 4) respectively. The feed rollers 221 are disposed to apply a force to a document fed through the ADF 220 in contact with the document. As shown in FIG. 4, the feed rollers 221 are coupled to a gear train 223 (hereinafter referred to as a gear mechanism 223) at their one ends with respect to their axial direction. The gear mechanism 223 comprises a plurality of gears and is configured to transmit a rotational force to each feed roller 221.

A motor 223A is a drive source for rotating the feed rollers 221, and a force of the motor 223A is transmitted to the feed rollers 221 via gears 223B and 223C. An electromagnetic solenoid 222 serves as an actuator for changing a force transmission path and a document feed path.

Figure 5:
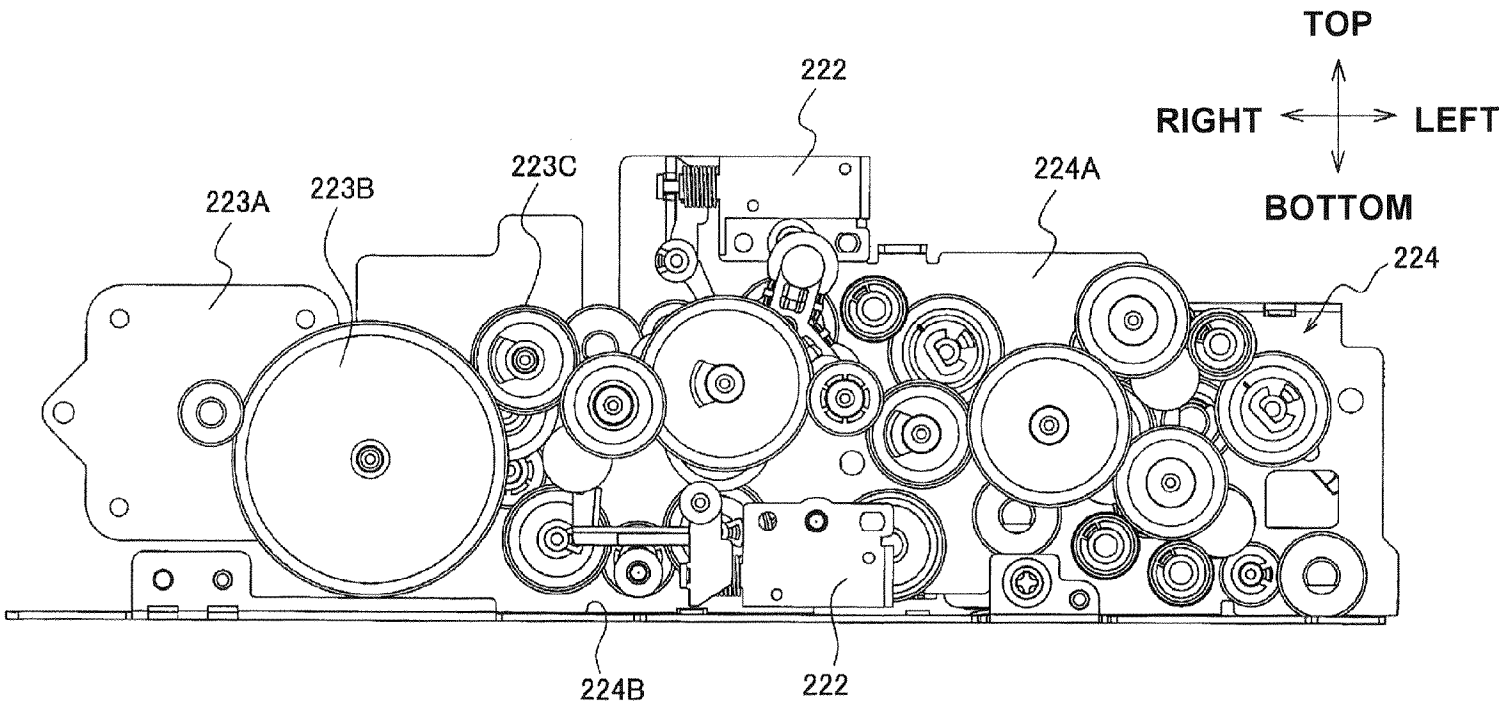
FIG. 5 is a rear view of the gear train of FIG. 4.
Figure 6:
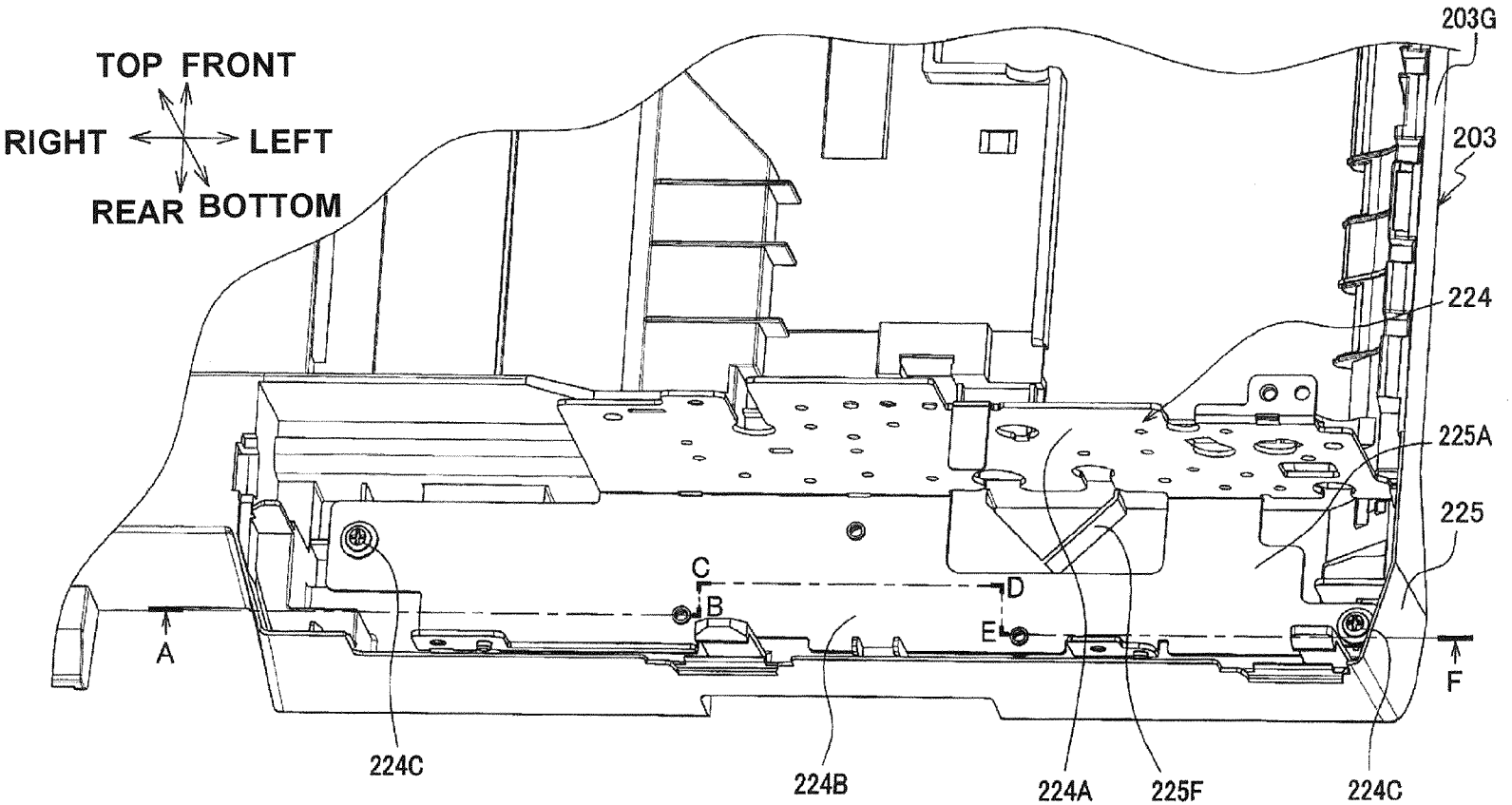
FIG. 6 is a partial perspective view showing a storage area according to an illustrative embodiment.

As shown in FIGS. 4 and 5, gears of the gear mechanism 223 are held by a gear holder 224 via shafts (not shown) fixed to the gear holder 224. As shown in FIG. 6, the gear holder 224 includes a holding wall 224A for holding gears and a base plate 224B for fixing the gear holder 224 to a gear cover 225.

The gear holder 224 can be made by press-working a steel plate in substantially an L shape in a cross sectional view so that the holding wall 224A and the base plate 224B are arranged substantially perpendicularly to each other.

The holding wall 224A has a flat rectangular shape such that its surface extends vertically and parallel to a document feed direction (or a front to rear direction of the image reading unit 200 in this illustrative embodiment). The base plate 224B has a flat rectangular shape such that its surface extends horizontally and parallel to the document feed direction. The base plate 224B is fixed to the gear cover 225 by, for example, a mechanical fastening device, e.g. screws 224C, at both ends with respect to a longitudinal direction of the base plate 224B.

Figure 7:
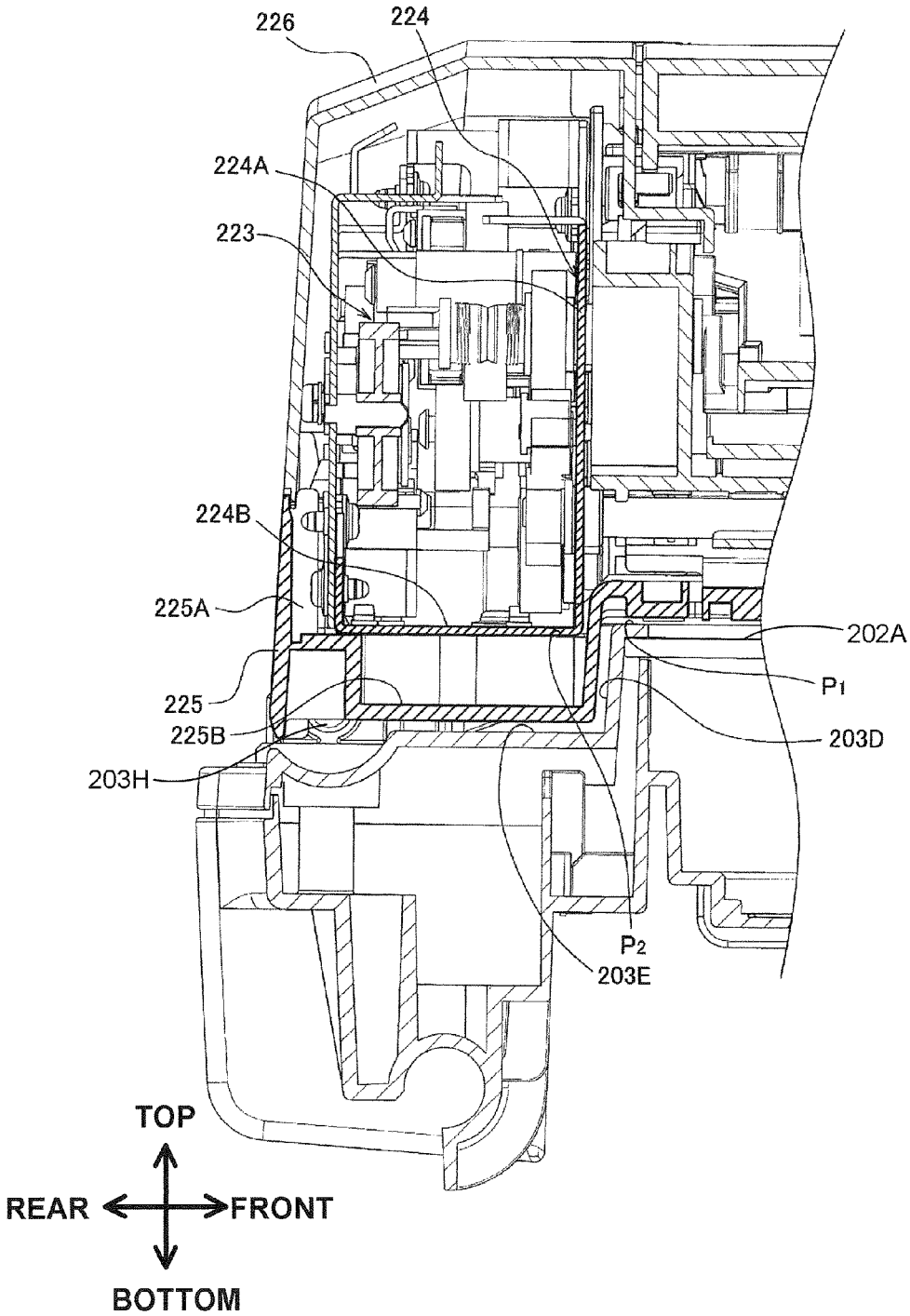
FIG. 7 is a cross sectional view taken along the line VII-VII of FIG. 3.

The gear cover 225 is molded of a resin such as high-impact polystyrene or HIPS integrally with a frame 203G of the document cover 203. As shown in FIG. 7, the gear cover 225 defines a storage space 225A for storing the gear mechanism 223, and covers a lower portion of the gear mechanism 223 in the storage space 225A.

Figure 8:
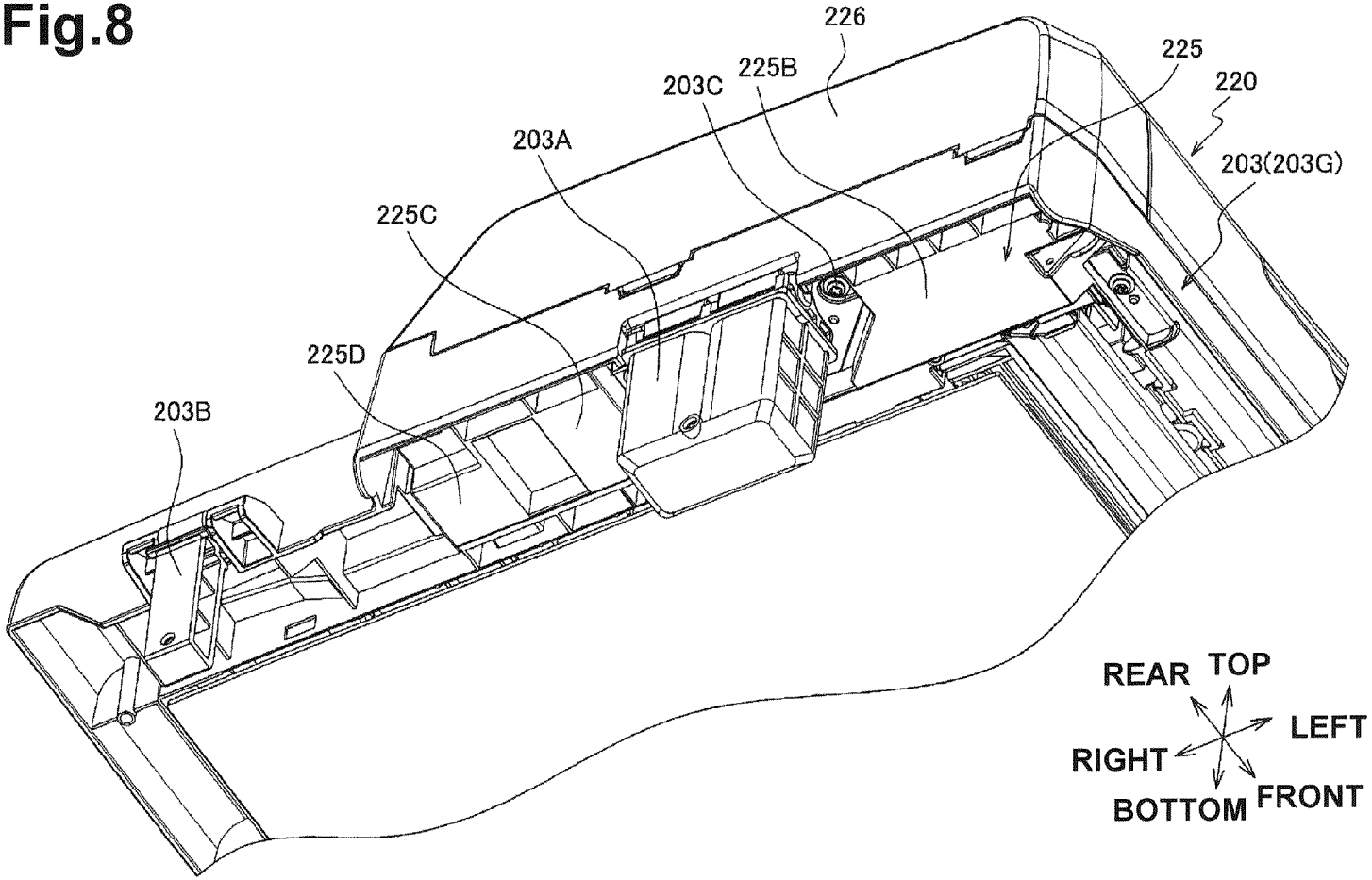
FIG. 8 is a perspective view of the document cover when viewed from bottom according to an illustrative embodiment.
Figure 9:
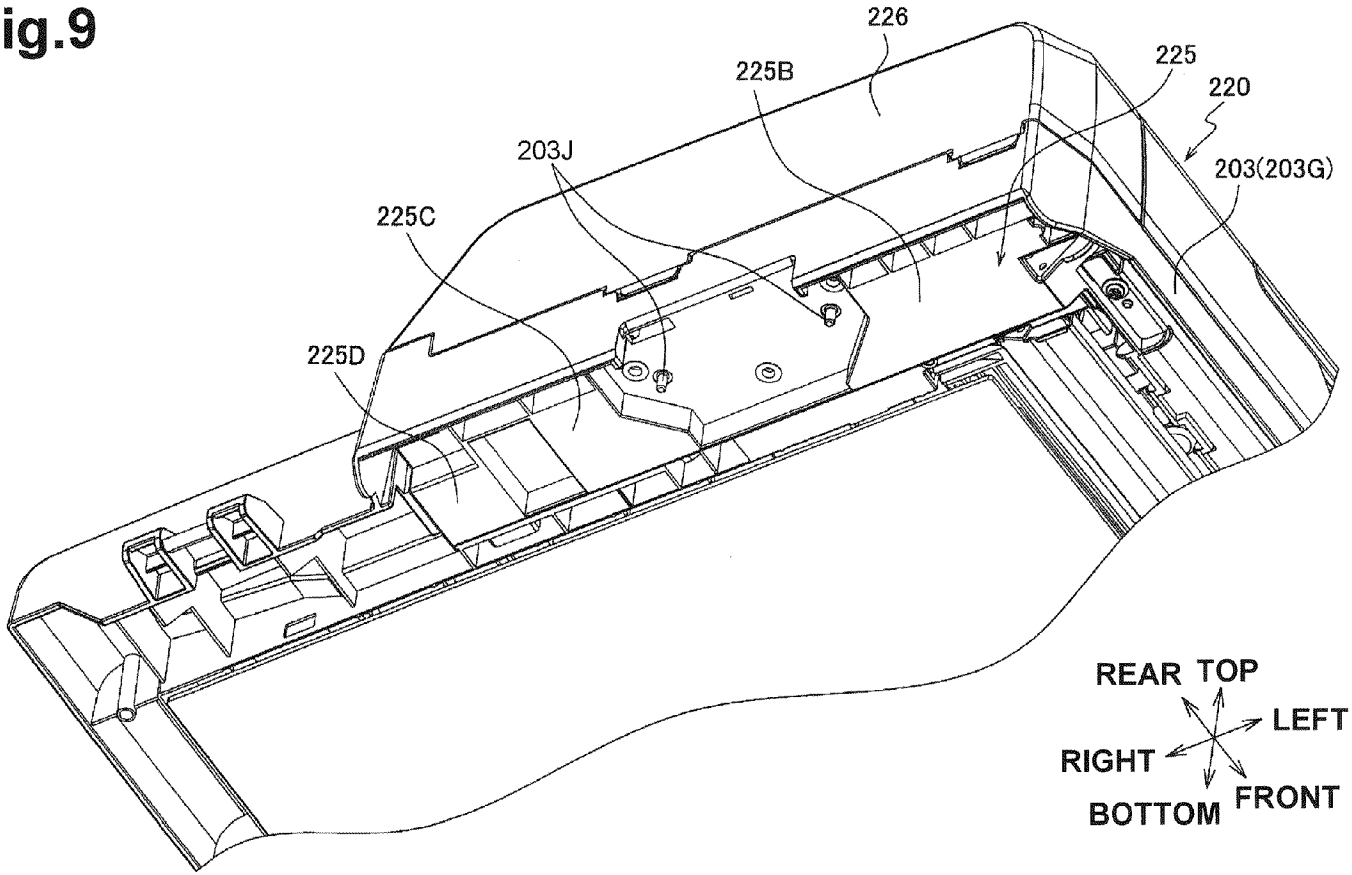
FIG. 9 is a perspective view of the document cover in which hinge mechanisms are removed, when viewed from bottom according to an illustrative embodiment.
Figure 10:
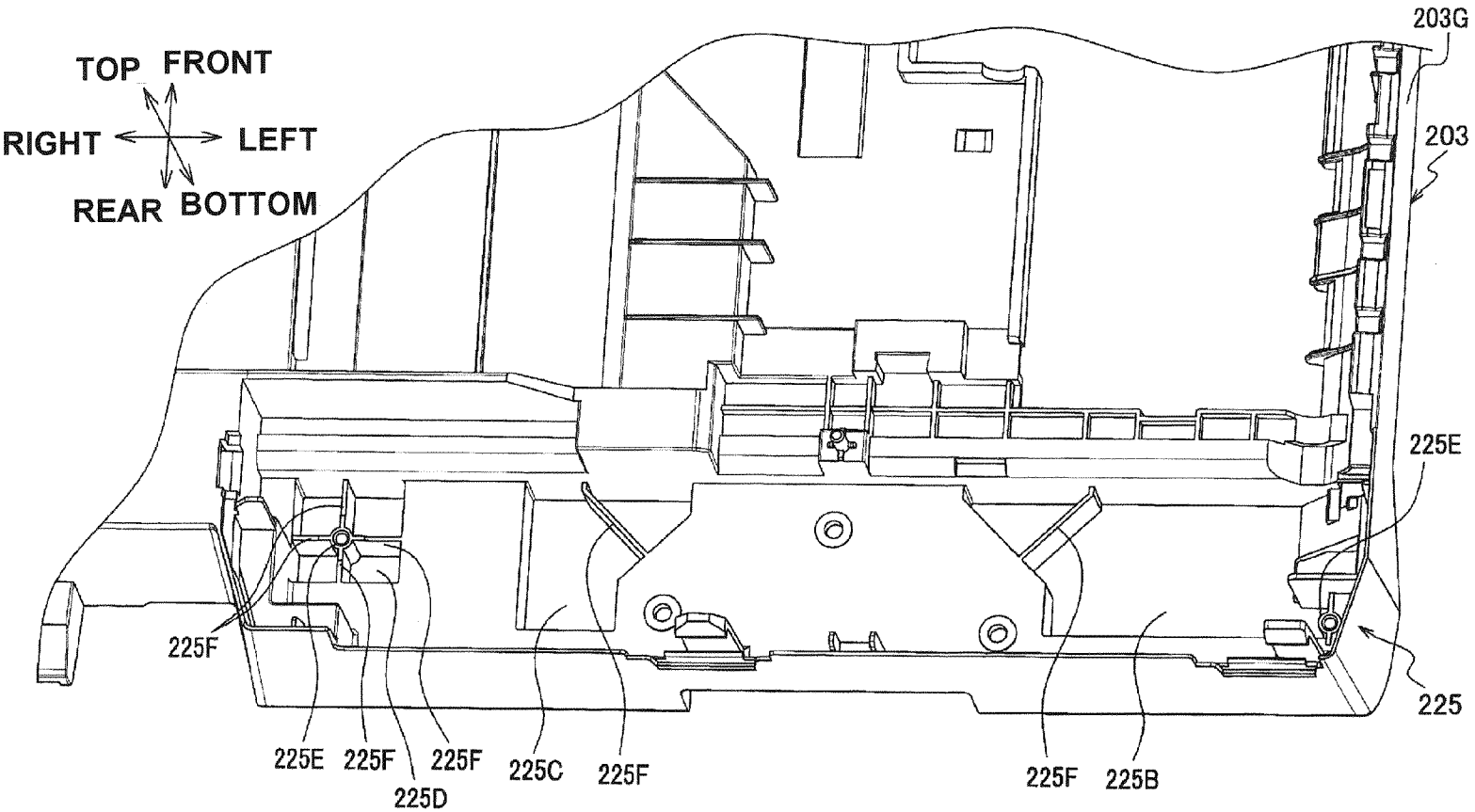
FIG. 10 is a perspective view of the storage area in which a gear holder is removed according to an illustrative embodiment.
Figure 11:
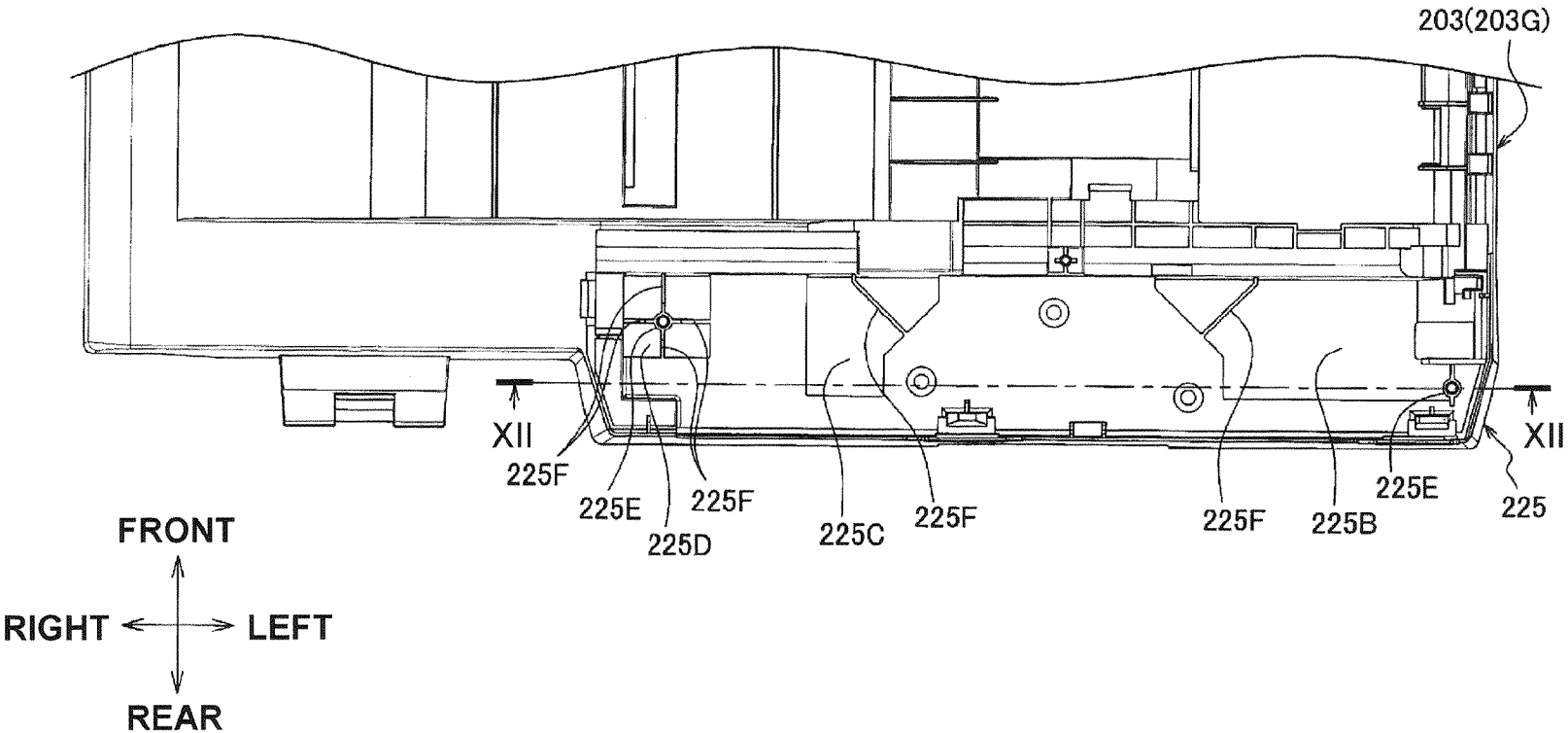
FIG. 11 is a top view of the storage area in which the gear holder is removed according to an illustrative embodiment.
Figure 12:
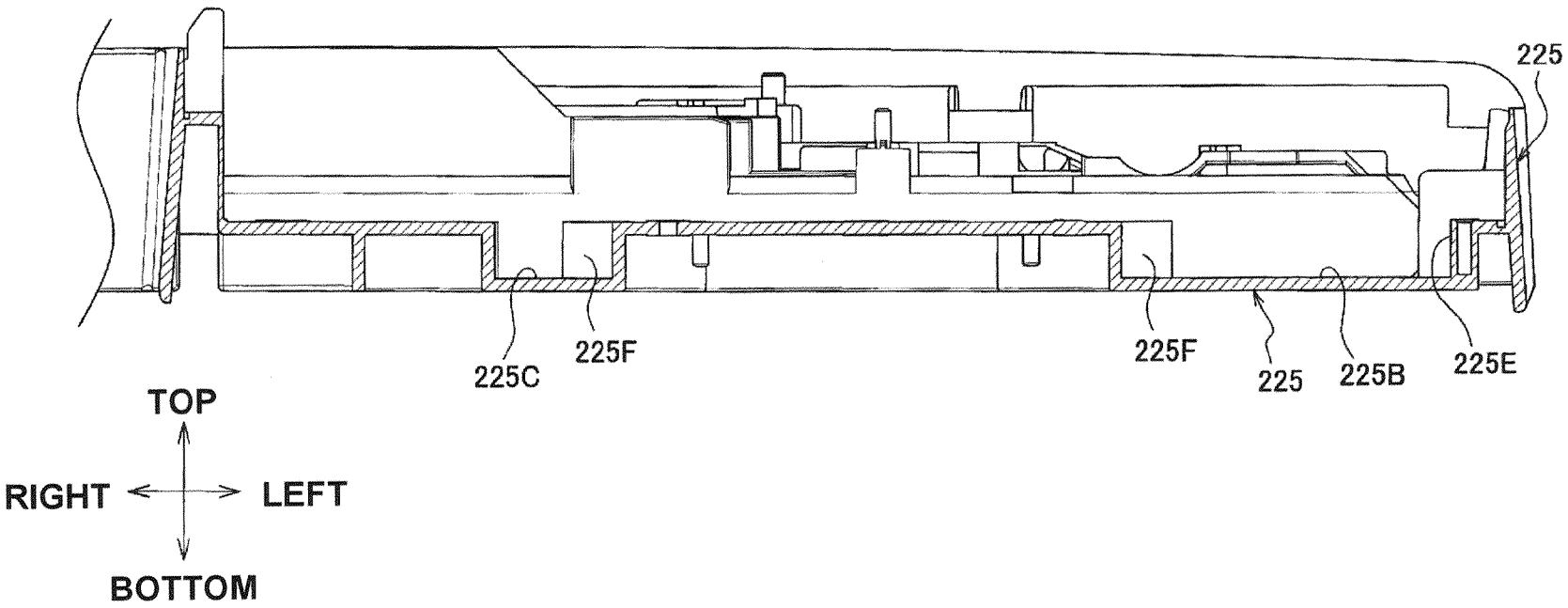
FIG. 12 is a cross sectional view taken along the line XII-XII of FIG. 11.

As shown in FIGS. 8 and 9, an upper portion of the storage space 225A is covered with an upper gear cover 226. The upper gear cover 226 is made of a resin and detachably attached to the document cover 203.

As shown in FIGS. 7 and 10-12, the gear cover 225 is formed with first, second and third protrusions 225B, 225C, and 225D. The first, second and third protrusions 225B, 225C, and 225D protrude downward below an upper end surface position P1 (FIG. 7) of the document table 201. In addition, the first, second, and third protrusions 225B, 225C, and 225D protrude further downward below the reading window 202A. The first, second and third protrusions 225B, 225C, and 225D may define hollow interiors, which are a lower part of the storage space 225A. The hollow interiors may be generally box-like in shape, and open toward the gear mechanism 223 or be open-topped. In the first and third protrusions 225B and 225D, bosses 225E (FIG. 10) can be formed integral with the gear cover 225. The bosses 225E have internal portions for receiving the screws 224C. In addition, the first, second, and third protrusions 225B, 225C, 225D are formed integrally with reinforcing walls 225F therein.

As shown in FIG. 7, a shaft 203H on which the hinge mechanism 203A rotates is located below the upper end surface position P1 of the document table 201.

Figure 13:
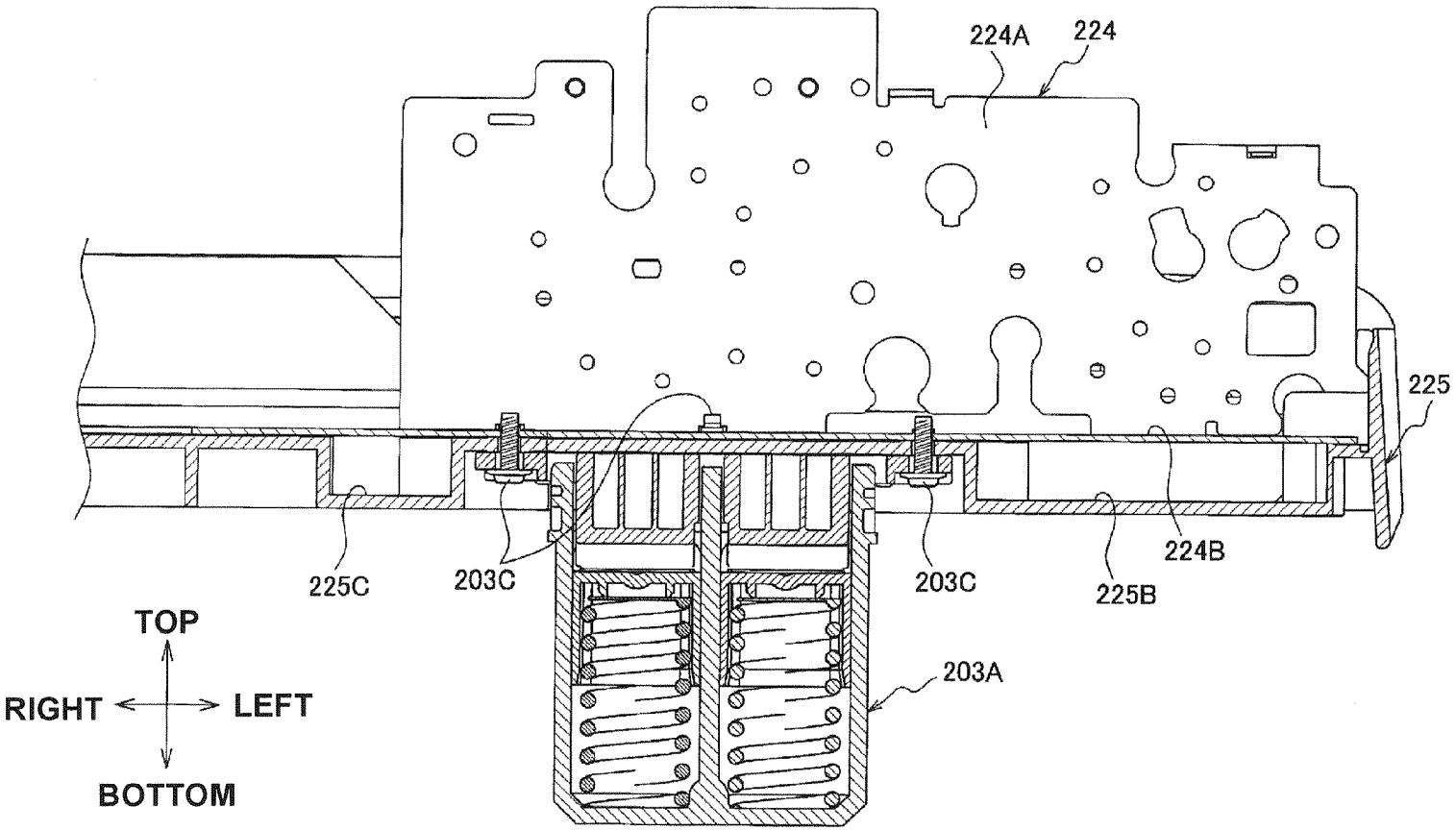
FIG. 13 is a cross sectional view taken along the line A, B, C, D, and E of FIG. 6.

As shown in FIG. 13, the base plate 224B of the gear holder 224 is fixed to the gear cover 225. The hinge mechanism 203A passes through the gear cover 225 at a portion between the first and second protrusions 225B and 225C and is fixed to the gear holder 224 using screws 203C fastened to the base plate 224B.

Thus, in the illustrative embodiment, the gear cover 225 is sandwiched between the base plate 224B and the hinge mechanism 203A. When the screws 203C are tightened, the gear cover 225, the base plate 224B of the gear holder 224, and the hinge mechanism 203A are firmly fixed to each other, so that the hinge mechanism 203A is integrated into the gear cover 225 of the document cover 203.

The hinge mechanism 203A of the illustrative embodiment is fixed to the gear holder 224 via the gear cover 225 by the screws 203C and positioned with respect to the gear cover 225 via positioning pins 203J (FIG. 9).

When the base plate 224B is fixed to the gear cover 225 a lower end position P2 of the gear holder 224 (which is a lower end surface of the base plate 224B) is located below the upper end surface position P1 of the document table 201 as shown in FIG. 7.

Figure 14:
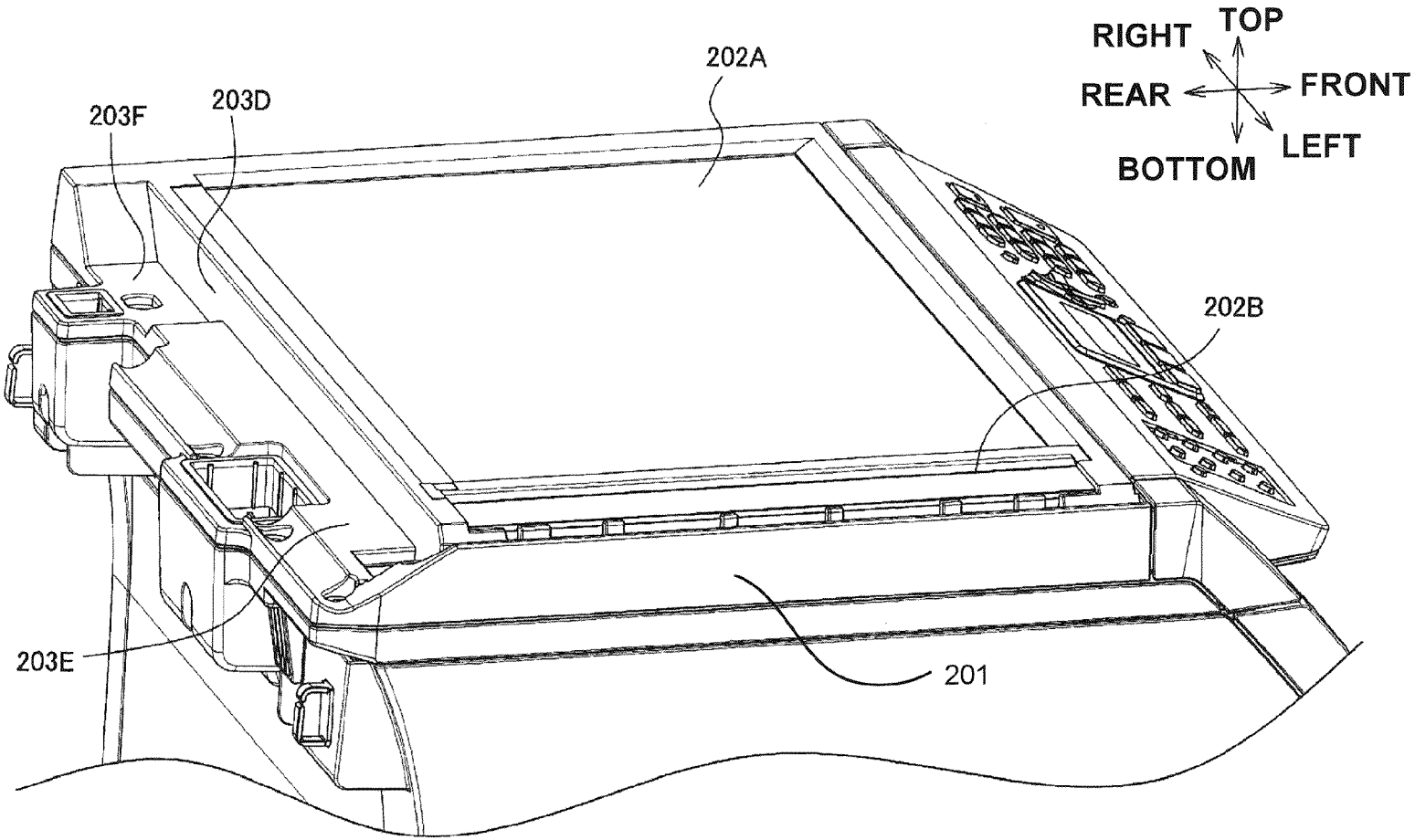
FIG. 14 is a perspective view of the image reading device in which the document cover is removed according to an illustrative embodiment.
Figure 15:
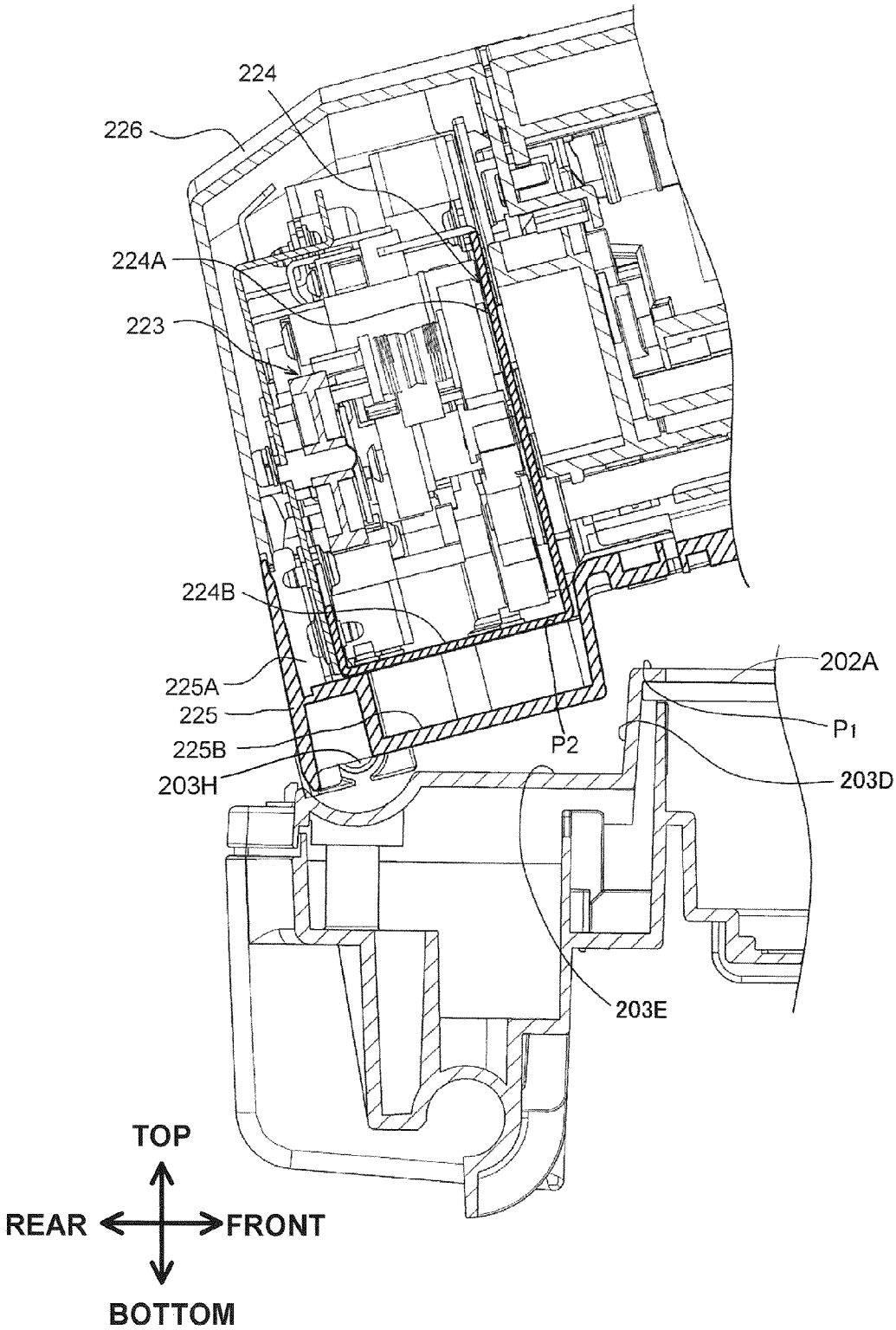
FIG. 15 is a cross sectional view showing an illustrative embodiment in which the document cover is open.

As shown in FIGS. 7, 14 and 15, the document table 201 integrally includes a first wall portion 203D and a second wall portion 203E. The first wall portion 203D extends substantially parallel to a protruding direction where the first, second, and third protrusions 225B, 225C, and 225D protrude (in a top to bottom direction in FIG. 7) so as to face side surfaces of the first, second, and third protrusions 225B, 225C, and 225D when the document cover 203 is in the first position. The second wall portion 203E extends substantially perpendicular to the protruding direction to face lower surfaces of the first, second, and third protrusions 225B, 225C, and 225D when the document cover 203 is in the first position.

In other words, the document table 201 has a recessed portion 203F (FIG. 14) that is defined by the first wall portion 203D and the second wall portion 203E in a position corresponding to the gear cover 225, and the first, second, and third protrusions 225B, 225C, and 225D are accommodated in the recessed portion 203F and stored in the document table 201 when the document cover 203 is in the first position.

In the illustrative embodiment, the first, second, and third protrusions 225B, 225C, and 225D that protrude downward are disposed in the gear cover 225 covering the lower part of the gear mechanism 223. Thus, the gear mechanism 223 can be accommodated in the storage space 225A including the first, second, and third protrusions 225B, 225C, and 225D.

For example, if a mechanism for automatically feeding and reading both sides of a document is added to the image reading unit 200, the size of the gear mechanism 223 would be increased because of an increase in the number of gears or a large-sized motor would be required as the motor 223A. In this case, the increased size of the gear mechanism may be accommodated in the storage space such that the image reading unit 200 can be prevented from increasing in size, for example height.

In the illustrative embodiment, the lower end position P2 of the gear holder 224 is located below the upper end surface position P1 of the document table 201 such that the image reading unit 200 can be decreased in height with respect to conventional image reading units.

As the first, second, and third protrusions 225B, 225C, and 225D protrude downward below the upper end position P1 of the document table 201 and further downward below the reading window 202A, they function as a light shield that prevents stray light from entering the first reading window 202A when a document is read using the flatbed reading function.

In addition, the shaft 203H of the hinge mechanism 203A is located below the upper end surface position P1 of the document table 201. With this configuration, when the document cover 203 is in the second position, the front end of the document cover 203 is retracted further toward the rear as compared with an image reading apparatus in which a document table has no recessed portion and a document cover has no protrusion protruding downward. Thus, it may be easier for a user to place a document on the first reading window 202A.

When the document cover 203 is pivoted, a great force acts on the hinge mechanism 203A. If the hinge mechanism 203A is simply attached to the gear cover 225, the gear cover 225 may be damaged.

To avoid the damage to the gear cover 225, a holder may be provided for fixing the hinge mechanism 203A. However, an increase in the number of parts and assembly steps of the image reading unit 200 may result.

In the illustrative embodiment, the hinge mechanism 203A is fixed to the gear holder 224 via the gear cover 225. As the gear holder 224 also functions as a holder for fixing the hinge mechanism 203A, the number of parts and assembly steps of the image reading unit 200 can be prevented from increasing.

For example, while the image reading unit 200 is moved, the gear cover 225 may collide with a body, which may result in damage to the gear cover 225.

In the illustrative embodiment, the first, second, and third protrusions 225B, 225C, and 225D can improve the overall mechanical strength of the gear cover. Even if the gear cover 225 collides with a body during movement of the image reading unit 200, the gear cover 225 is more likely to avoid getting damaged.

In the illustrative embodiment, the gear holder 224 is made of metal, the hinge mechanism 203A is fixed to the gear holder 224 with the gear cover 225 sandwiched between the hinge mechanism 203 and the gear holder 224, and the gear holder 224 is fixed to the gear cover 225 by the screws 224C in the first protrusion 225B and the third protrusion 225D. With this configuration, the gear cover 225 and the gear holder 224 are integrated.

Thus, the gear cover 225 can be reinforced with the gear holder 224, and the mechanical strength of the gear cover 225 can be increased. When the document cover 203 is pivoted or a great force acts on the document cover 203, the gear cover 225 to which the hinge mechanism 203A is assembled can be prevented from getting damaged.

In the illustrative embodiment, the first wall portion 203D and the second wall portion 203E are disposed in the document table 201. When the document cover 203 is pivoted or a great force acts on the document cover 203 because of a drop during movement of the image forming apparatus 1 (or image reading unit 200), the first, second, and third protrusions 225B, 225C, and 225D contact the first wall portion 203D or the second wall portion 203E, thereby lessening the force acting on the hinge mechanism 203A and reducing the likelihood of damage to the hinge mechanism 203A.

In other words, when a force acts on the document cover 203 in a direction substantially parallel to the protruding direction of the first, second, and third protrusions 225B, 225C, and 225D, the first, second, and third protrusions 225B, 225C, and 225D contact the first wall portion 203D, which absorbs the force acting on the hinge mechanism 203A.

In addition, when a force acts on the document cover 203 in a direction crossing the protruding direction of the first, second, and third protrusions 225B, 225C, and 225D, the first, second, and third protrusions 225B, 225C, and 225D contact the first wall portion 203D, which absorbs the force acting on the hinge mechanism 203A.

In the illustrative embodiment, as shown in FIG. 13, the first protrusion 225B and the second protrusion 225C are located on both sides of the hinge mechanism 203A. In other words, the hinged mechanism 203A is sandwiched between the first protrusion 225B and the second protrusion 225C both having enhanced mechanical strength. Thus, even if a great force acts on the hinge mechanism 203A, the gear cover 225 can be prevented from getting damaged.

When the document cover 203 reaches the first position, the first, second, and third protrusions 225B, 225C, and 225D fit in the recessed portion 203F of the document table 201. Thus, the image reading unit 200 exhibits a smooth external appearance without unnecessary projections and depressions.

In the above illustrative embodiment, the storage area 225A includes the first, second, and third protrusions 225B, 225C, and 225D, and the gear mechanism 223 is accommodated in a part of the storage area 225A. However, the entire or a substantial portion of the storage area 225A may accommodate the gear mechanism 223.

In the above illustrative embodiment, the first, second, and third protrusions 225B, 225C, and 225D define hollow interiors that are generally box-like in shape. However, the hollow interiors of the protrusions 225B, 225C, and 225D may be formed in any shape.

In the above illustrative embodiment, the lower end position P2 of the gear holder 224 is located below the upper end surface position P1 of the document table 201. However, when the gear cover 225 is located below the upper end surface position P1 of the document table 201, the lower end position P2 of the gear holder 224 may be flush with the upper end surface position P1 of the document table 201.

In the above illustrative embodiment, the gear holder 224 is made of metal and the gear cover 225 is made of resin. However, the gear holder 224 and the gear cover 225 may be made of resin.

In the above illustrative embodiment, the hinge mechanism 203A is fixed to the gear holder 224 such that the gear cover 225 is sandwiched between the base plate 224B of the gear holder 224 and the hinge mechanism 203A. However, the invention is not limited to this configuration.

In the above illustrative embodiment, the gear cover 225 and the frame 203G are formed as a single piece. However, the gear cover 225 and the frame 203G may be formed as separate pieces.

In the above illustrative embodiment, the electrophotographic image forming device can be used as the image forming device 100. Instead, an inkjet image forming device may be applied to the image forming device 100.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the embodiment and examples of modifications disclosed herein are merely illustrative. It is to be understood that the scope of the invention is not to be so limited thereby, but is to be determined by the claims which follow.

What is claimed is:

1. An image reading apparatus comprising:

a main body comprising:

a document table including a reading window, the reading window defining a flat surface configured to receive a document thereon;

an image reader configured to read an image on the document; and a recessed portion extending below an upper end surface of the document table;

a pivotal unit configured to pivot between a first position and a second position, the pivotal unit comprising:

a document cover configured to cover the reading window in a case that the pivotal unit is in the first position and expose the reading window in a case that the pivotal unit is in the second position;

an automatic document feeder configured to automatically feed a document, the automatic document feeder comprising:

a feed roller extending in a direction perpendicular to an axis and configured to convey the document;

a gear train disposed on an end of the feed roller with respect to an axial direction of the feed roller, the gear train including a plurality of gears and being configured to transmit a rotational force to the feed roller; and a gear holder that holds the gear train, wherein a lower end of the gear holder is flush with or below the upper end surface of the document table in the case that the pivotal unit is in the first position; and a first protrusion protruding below the upper end surface of the document table in the recessed portion in the case that the pivotal unit is in the first position; and a hinge mechanism configured to allow the pivotal unit to pivot about the axis relative to the main body, the axis being located below the upper end surface of the document table, the hinge mechanism including a first hinge and a second hinge, the first hinge and the second hinge being spaced apart from each other in a direction parallel to the axis, the recessed portion extending at least from the first hinge to the second hinge, wherein the first protrusion defines a hollow interior that is generally box-like in shape and open toward the gear train.

2. The image reading apparatus according to claim 1, wherein the first hinge is fixed to the gear holder.

3. The image reading apparatus according to claim 1, wherein the document table includes a first wall portion extending vertically and a second wall portion extending horizontally, and wherein the first wall portion and the second wall portion define the recessed portion.

4. An image reading apparatus comprising:

a main body comprising:

a document table including a reading window, the reading window defining a flat surface configured to receive a document thereon;

an image reader configured to read an image on the document; and a recessed portion extending below an upper end surface of the document table;

a pivotal unit configured to pivot between a first position and a second position, the pivotal unit comprising:

a document cover configured to cover the reading window in a case that the pivotal unit is in the first position and expose the reading window in a case that the pivotal unit is in the second position;

an automatic document feeder configured to automatically feed a document; and a first protrusion protruding below the upper end surface of the document table in the recessed portion in the case that the pivotal unit is in the first position; and a hinge mechanism configured to allow the pivotal unit to pivot about an axis relative to the main body, the axis being located below the upper end surface of the document table, the hinge mechanism including a first hinge and a second hinge, the first hinge and the second hinge being spaced apart from each other in a direction parallel to the axis, the recessed portion extending at least from the first hinge to the second hinge, wherein the pivotal unit includes a second protrusion and the first hinge is disposed between the first protrusion and the second protrusion.

5. The image reading apparatus according to claim 4, wherein the automatic document feeder comprises:

a feed roller extending in a direction perpendicular to the axis and configured to convey the document;

a gear train disposed on an end of the feed roller with respect to an axial direction of the feed roller, the gear train including a plurality of gears and being configured to transmit a rotational force to the feed roller; and a gear holder that holds the gear train, wherein a lower end of the gear holder is flush with or below the upper end surface of the document table in the case that the pivotal unit is in the first position.

6. An image forming apparatus comprising:

an image forming device configured to form an image on a recording medium; and an image reader comprising:

a main body comprising:

a document table including a reading window, the reading window defining a flat surface configured to receive a document thereon;

an image reader configured to read an image on the document; and a recessed portion extending below an upper end surface of the document table;

a pivotal unit configured to pivot between a first position and a second position, the pivotal unit comprising:

a document cover configured to cover the reading window in a case that the pivotal unit is in the first position and expose the reading window in a case that the pivotal unit is in the second position;

an automatic document feeder configured to automatically feed a document; and a first protrusion protruding below the upper end surface of the document table in the recessed portion in the case that the pivotal unit is in the first position; and a hinge mechanism configured to allow the pivotal unit to pivot about an axis relative to the main body, the axis being located below the upper end surface of the document table, the hinge mechanism including a first hinge and a second hinge, the first hinge and the second hinge being spaced apart from each other in a direction parallel to the axis, the recessed portion extending at least from the first hinge to the second hinge, wherein the pivotal unit includes a second protrusion and the first hinge is disposed between the first protrusion and the second protrusion.

7. The image forming apparatus according to claim 6, wherein the document table includes a first wall portion extending vertically and a second wall portion extending horizontally, and wherein the first wall portion and the second wall portion define the recessed portion.

8. The image forming apparatus according to claim 6, wherein the automatic document feeder comprises:

a feed roller extending in a direction perpendicular to the axis and configured to convey the document;

a gear train disposed on an end of the feed roller with respect to an axial direction of the feed roller, the gear train including a plurality of gears and being configured to transmit a rotational force to the feed roller; and a gear holder that holds the gear train, wherein a lower end of the gear holder is flush with or below the upper end surface of the document table in the case that the pivotal unit is in the first position.

9. The image forming apparatus according to claim 8, wherein the first hinge is fixed to the gear holder.

* * * * *